US010026569B2

(12) United States Patent
Danowski et al.

(10) Patent No.: US 10,026,569 B2
(45) Date of Patent: Jul. 17, 2018

(54) MODULAR SWITCH PANEL ASSEMBLY

(71) Applicants: Thomas J. Danowski, Schaumburg, IL (US); George L. Cepynsky, Lisle, IL (US); Paul G. Cepynsky, Lisle, IL (US)

(72) Inventors: Thomas J. Danowski, Schaumburg, IL (US); George L. Cepynsky, Lisle, IL (US); Paul G. Cepynsky, Lisle, IL (US)

(73) Assignee: Precision Circuits Inc., Downers Grove, IL (US)

( * ) Notice: Subject to any disclaimer, the term of this patent is extended or adjusted under 35 U.S.C. 154(b) by 0 days.

(21) Appl. No.: 15/014,418

(22) Filed: Feb. 3, 2016

(65) Prior Publication Data

US 2017/0221654 A1 Aug. 3, 2017

(51) Int. Cl.

| | |
|---|---|
| ***H01H 13/70*** | (2006.01) |
| ***H01H 13/10*** | (2006.01) |
| ***H01H 13/04*** | (2006.01) |
| *H01H 13/14* | (2006.01) |

(52) U.S. Cl.

CPC ..... *H01H 13/70* (2013.01); *H01H 13/04* (2013.01); *H01H 13/10* (2013.01); *H01H 13/14* (2013.01); *H01H 2207/04* (2013.01); *H01H 2221/044* (2013.01)

(58) Field of Classification Search

CPC ..... H01H 2221/054; H01H 2221/044; H01H 13/705; H01H 2025/048; H01H 13/14; H01H 2221/08; H01H 2235/006; H01H 2235/028

USPC ..... 200/341–345, 314, 520, 11 G, 5 A

See application file for complete search history.

(56) References Cited

U.S. PATENT DOCUMENTS

| | | | | | |
|---|---|---|---|---|---|
| 5,475,192 | A * | 12/1995 | Inagaki | H01H 13/705 | 200/341 |
| 2006/0040081 | A1* | 2/2006 | Hodsdon | G09F 3/02 | 428/40.1 |
| 2010/0038223 | A1* | 2/2010 | Laurent | H01H 13/70 | 200/310 |
| 2011/0036693 | A1* | 2/2011 | Lin | H01H 13/023 | 200/314 |
| 2011/0048909 | A1* | 3/2011 | Clark | H01H 9/181 | 200/330 |

* cited by examiner

*Primary Examiner* — Ahmed Saeed
(74) *Attorney, Agent, or Firm* — Schiff Hardin LLP

(57) ABSTRACT

In a modular switch panel assembly, a switch cover with an aperture and a switch button having a button portion and an integral mounting portion are provided. The mounting portion comprises at least first and second spring members protruding laterally of and at opposite sides of the button portion. Each of the spring members has a meandering path shape and has one end integral with the button portion and an opposite end attached to the switch cover such that the button portion extends through the aperture. A printed circuit board has a switch, and is attached to the switch cover such that the switch is adjacent to a bottom surface of the switch button.

19 Claims, 7 Drawing Sheets

MODULAR SWITCH PANEL ASSEMBLY

BACKGROUND

Switch panels are known having one or more switches activated by respective switch buttons mounted in a panel to be used in conjunction with a multiplex electronic control system, such as in recreational vehicles (RV vehicles) in the RV industry. The known switch panel is designed to have a unique nomenclature for each button. The nomenclature is printed on each button or on labels placed on the buttons to indicate the button function. The button can also be back lit by means of LEDs located below or behind the button on a printed circuit board (PCB) on which the switch is located.

SUMMARY

It is an object to improve upon the existing switch panel such that it has improved switch button activation characteristics and a modular design which will allow convenient expansion from a single button to multiple buttons depending on the PCB and switch cover configuration used.

In a modular switch panel assembly, a switch cover with an aperture and a switch button having a button portion and an integral mounting portion are provided. The mounting portion comprises at least first and second spring members protruding laterally of and at opposite sides of the button portion. Each of the spring members has a meandering path shape and has one end integral with the button portion and an opposite end attached to the switch cover such that the button portion extends through the aperture. A printed circuit board has a switch, and is attached to the switch cover such that the switch is adjacent to a bottom surface of the switch button.

DESCRIPTION OF EXEMPLARY EMBODIMENTS

Figure 1:
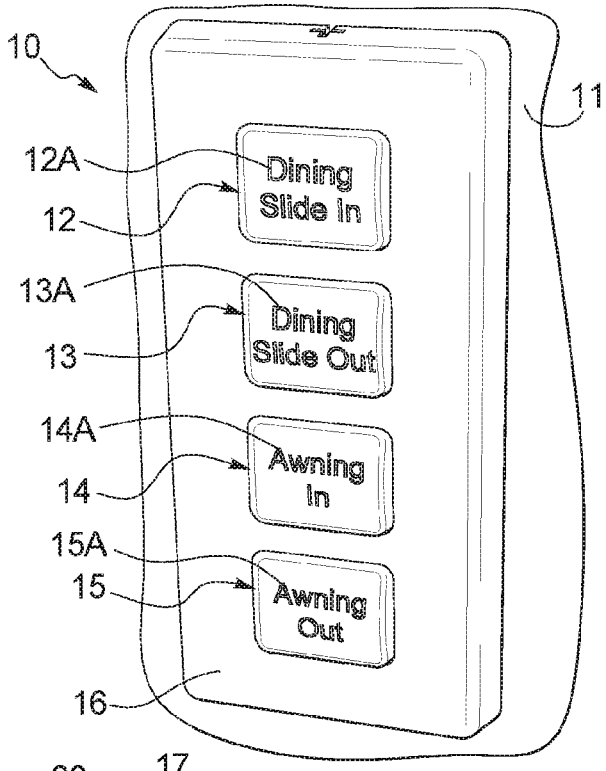
FIG. 1 is a front perspective view of a modular switch panel assembly of one exemplary embodiment mounted to a mounting surface.

For purposes of promoting an understanding of the principles of the invention, reference will now be made to the preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

FIG. 1 shows in perspective a modular switch panel assembly 10 according to one exemplary embodiment. Four switch buttons 12-15 are illustrated mounted to a switch cover 16. The switch panel assembly 10 is mounted to a mounting surface 11 as described hereafter.

As shown in FIG. 1, respective nomenclature indicia 12A-15A are provided on the face of the respective switch buttons 12-15. The indicia shown are for use of the switch panel assembly in an RV vehicle although many other uses of the switch panel assembly may be employed for other electronic control-systems. The button can be backlit by means of an LED located below the respective buttons on the printed circuit board described hereafter. Also as further described hereafter, the switch panel assembly is a modular design that can be expanded from a single button to multiple buttons depending on the PCB and switch cover configuration used. For example 2, 4, and 6 button configurations may be employed depending on the application.

The indicia 12A-15A may be a stick on label applied to the face of the switch button or alternatively may be engraved or printed on the face of the switch button.

Figure 2:
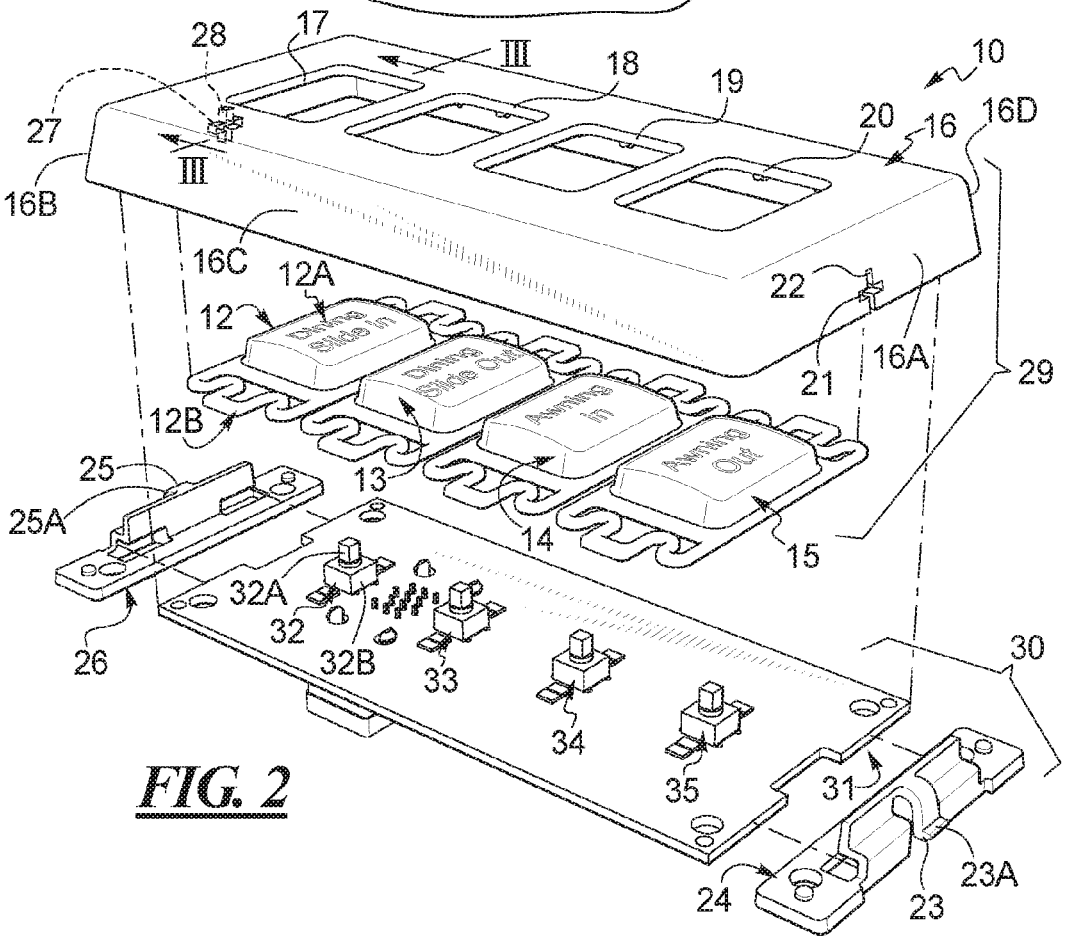
FIG. 2 is a blow up perspective view of the switch panel assembly of FIG. 1.

As shown in the exploded perspective view of FIG. 2, the modular switch panel assembly 10 has the switch cover 16 provided with respective rectangular apertures 17-20 for receiving the respective switch buttons 12-15. Although rectangular apertures and rectangular switch buttons are illustrated the switch buttons could be of other shapes such as round. One end wall 16A of the cover 16 has a first switch cover slot 21 and an orthogonal second switch cover slot 22 which together form the shape of a cross. Each of these slots is for purpose of receiving a tool such as flat head screw driver for pushing on a retainer spring finger 23 of a PCB retainer 24 described in greater detail hereafter. A similar retainer 26 with a respective second retainer spring finger 25 lies opposite the first PCB retainer 24. Similarly an additional switch cover slot 27 and corresponding additional orthogonal slot 28 forming a cross are provided at the opposite end of the cover 16 as shown in dash lines.

The switch cover 16 has a downwardly extending apron formed by end walls 16A and 16B and sidewalls 16C and 16D.

The switch buttons 12-15 each have, as explained for switch button 12, a button portion 12A and a mounting portion 12B which is integral with the button portion 12A. The switch button 12 may be a single plastic molding although other structures may be employed such as 1 or 2 piece, or made of metal. The switch buttons engaged with the switch cover 16 forms a switch cover sub-assembly 29.

As also shown in FIG. 2, a PCB sub-assembly 30 is formed from a PCB 31 and the first and second PCB retainers 24 and 26. Respective switches 32-35 are mounted to the PCB 31 such as by soldering at terminal leads thereof to the PCB. The switches may be push button switches, although other types of switches may be employed. Of course other mounting methods may be employed. The switches 32-35 each comprise, as shown for the switch 32, a spring loaded push button portion 32A received in a switch body portion 32B. The push button switches may be momentary contact upon pushing of the push button portion into the body portion, or may be a toggle action wherein with a first push the switch is on and with a second push the switch is off. The switches 32-35 may be single pole or multi-pole switches. The modular switch panel assembly 10 comprises the two sub-assemblies—the switch cover sub-assembly 29 and the PCB sub-assembly 30.

Figure 3:
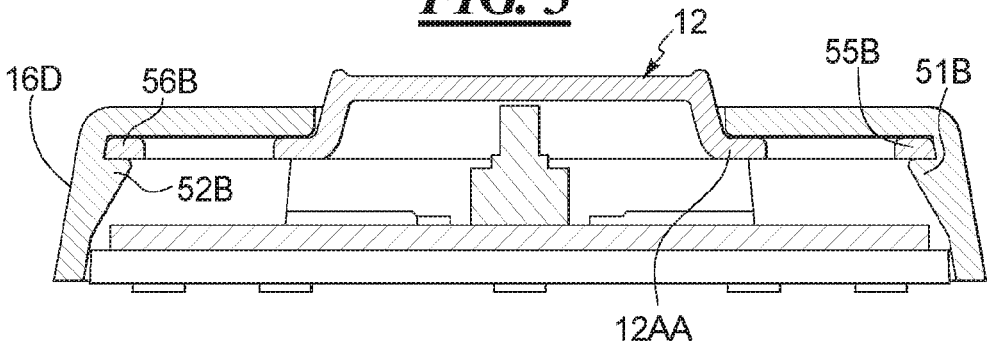
FIG. 3 is a cross-sectional view of the fully assembled switch panel assembly of FIG. 2 with the cross-section being taken along line III-III of FIG. 2.

FIG. 3 shows a cross-sectional view of the assembled switch panel assembly along section line III-III shown in FIG. 2. The mounting of the switch buttons such as 12 by use of ribs 51A, B, C and 52A, B, C will be explained hereinafter in connection with FIG. 8.

Figure 4:
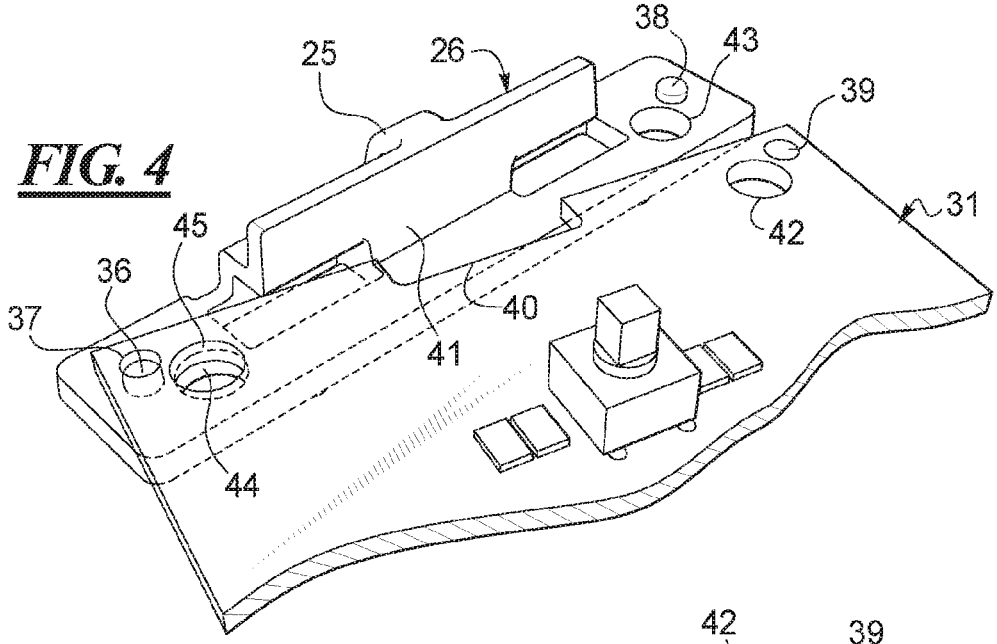
FIG. 4 is a fragmentary perspective view of a first assembly step of a first sub-assembly of the switch panel assembly of FIG. 2.
Figure 5:
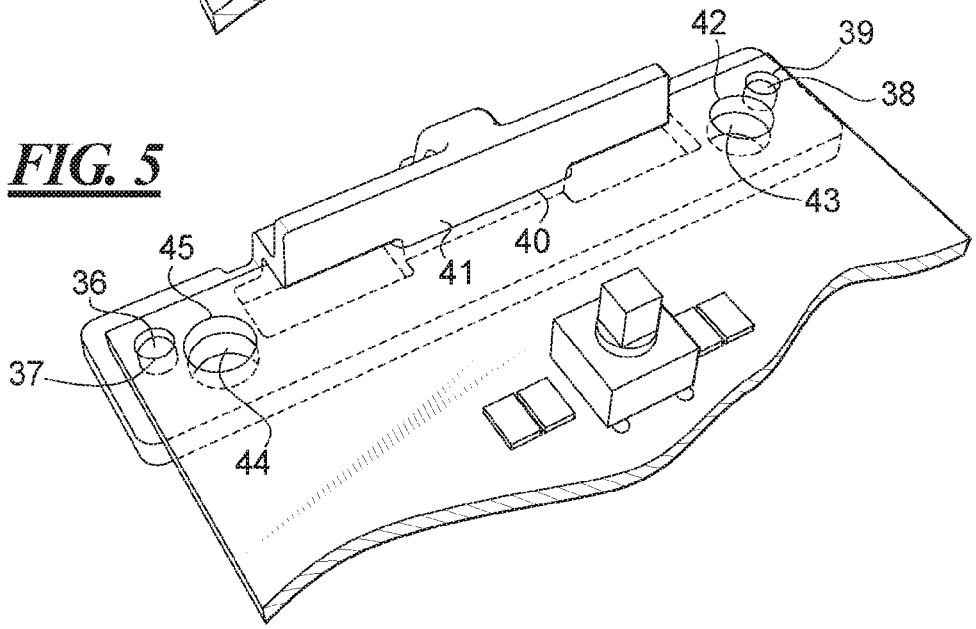
FIG. 5 is a fragmentary perspective view of a second assembly step for the first sub-assembly of the switch panel assembly of FIG. 2.

FIG. 4 shows a first step and FIG. 5 shows a second step of a procedure for assembling the PCB retainer 26 to one end of the PCB 31. First a boss 36 of retainer 26 is inserted into a hole 37 of PCB 31. The retainer 26 is then rotated about boss 36 towards the end of the PCB 31, this allowing another boss 38 of retainer 26 to snap into the hole 39 on the other side of the PCB so that the retainer 26 is then captured at the end of the PCB 31. In this configuration note that holes 44 and 45 and 42 and 43 are aligned for receiving respective mounting screws as described hereafter. Similarly the other retainer 24 at the opposite end of the PCB 31 is captured by the opposite end of the PCB 31. Further note cut-out 40 and extension 41 moving from a non-engaged position in FIG. 4 to an engaged position in FIG. 5.

Figure 6:
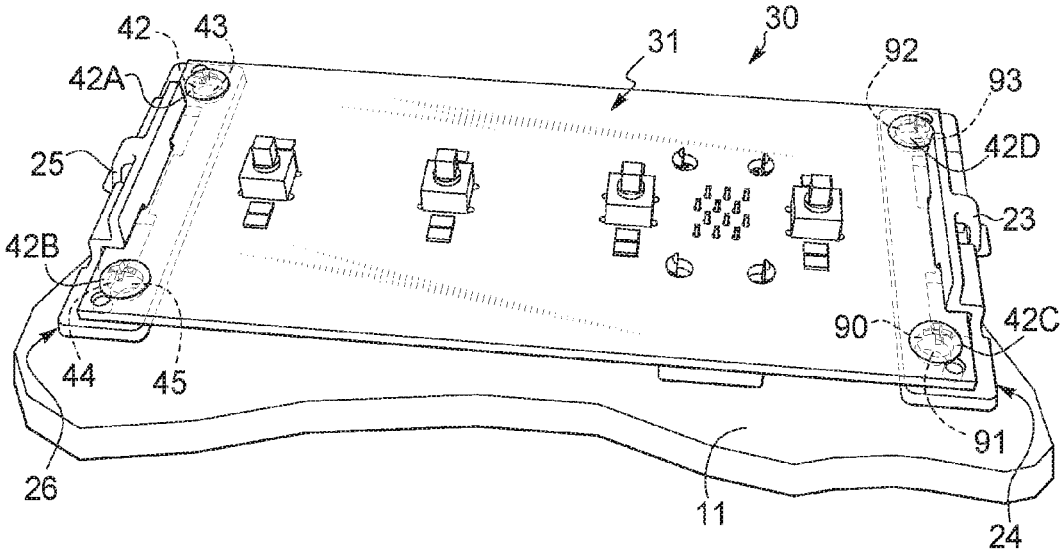
FIG. 6 is a top perspective view of the first sub-assembly being mounted to a mounting surface.

FIG. 6 illustrates mounting of the PCB sub-assembly 30 onto the mounting surface 11 by use of four screws 42A-42D at the four corners of the PCB 31 and passing through respective aligned holes such as 42, 43 and 44, 45 shown in dash lines in FIG. 6, and aligned holes 90, 91 and 92, 93 also shown in dash lines in FIG. 6.

Figure 7:
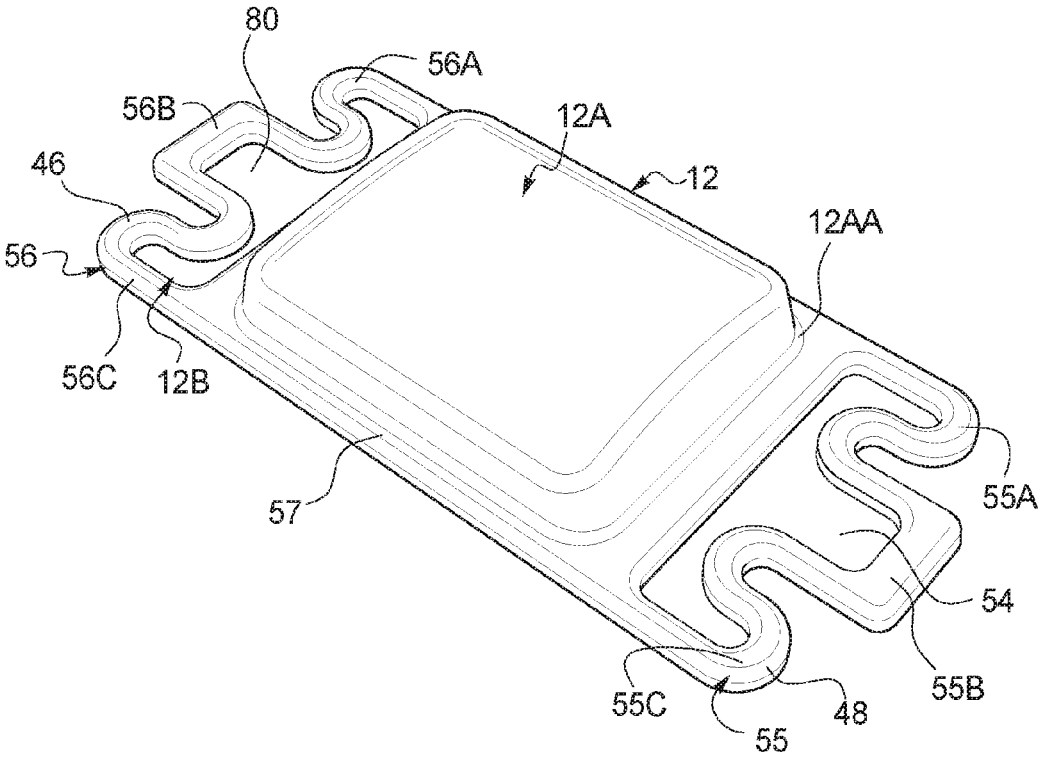
FIG. 7 is a perspective view of one of a plurality of switch buttons shown in the switch panel assembly of FIG. 2.
Figure 8:
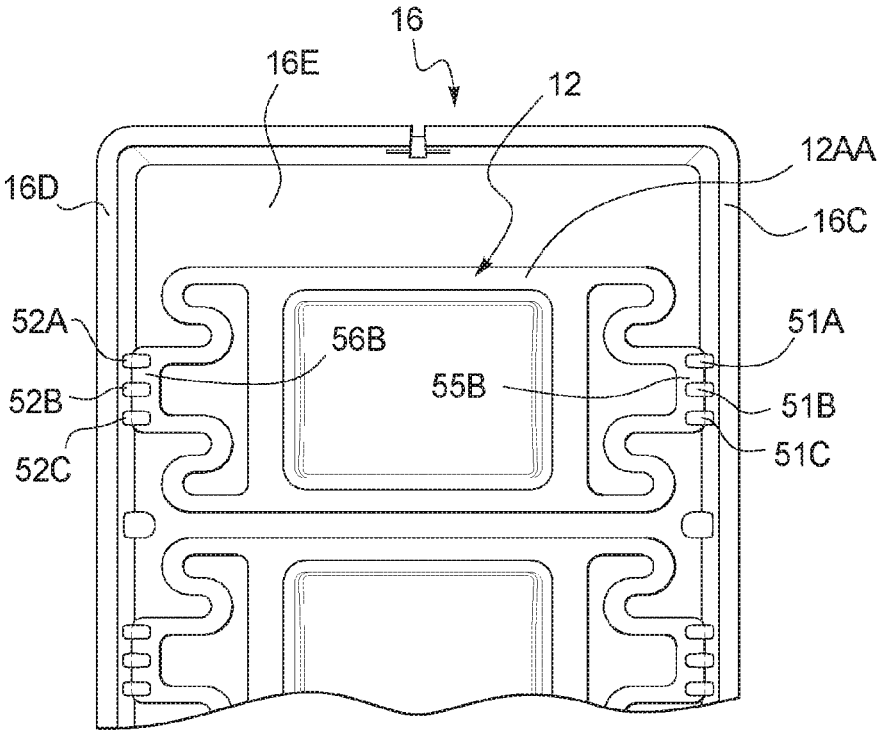
FIG. 8 is a fragmentary bottom plan view showing one of the switch buttons mounted to a switch cover to form a second sub-assembly of the switch panel assembly of FIG. 2.

Assembly of the switch cover sub-assembly 29 is explained by reference to FIGS. 7 and 8. As shown in FIG. 7, the switch button 12 mounting portion 12B has first and second spring members comprising respective springy mounting tabs 55 and 56 at opposite ends of the mounting portion 12B. Springy mounting tab 55 is formed of a mounting tab portion 55B attached by first and second S-shaped spring portions 55A and 55C to a main body 57 of the mounting portion 12B. Similarly springy mounting tab 56 has a mounting tab portion 56B flanked by and attached to the main body 57 by respective S-shaped spring portions 56A and 56C. As shown in FIG. 8 and also in the cross sectional view of FIG. 3, three engagement ribs 51A, 51B, and 51C spaced apart and parallel to each other extend from an inner surface of the side wall 16C and engage with the mounting tab portion 55B. Similarly on the opposite side engagement ribs 52A, 52B, and 52C extend from the side wall 16D and engage with the mounting tab portion 56B. An open region 54 is defined within springy mounting tab 55 and an open region 80 is defined within springy mounting tab 56.

Figure 9:
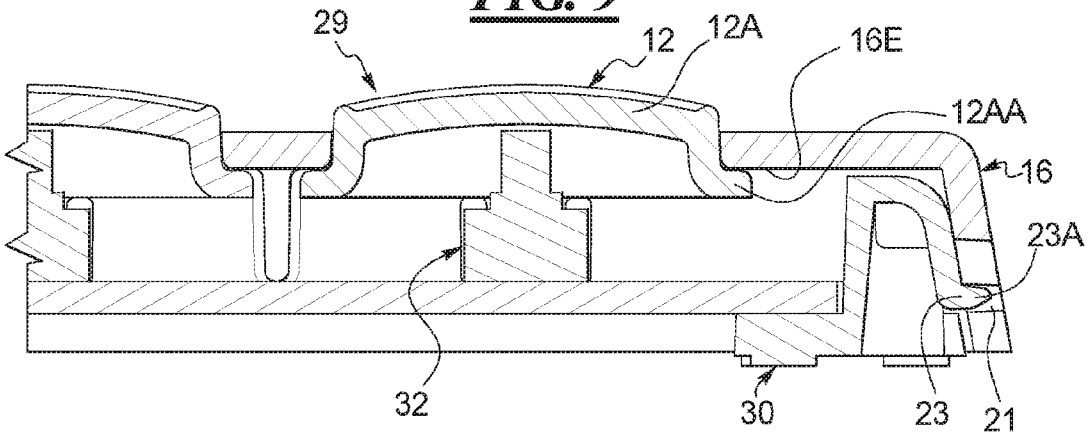
FIG. 9 is a cross-sectional fragmentary side view along line IX-IX in FIG. 11 with the second sub-assembly mounted to the first sub-assembly.
Figure 10:
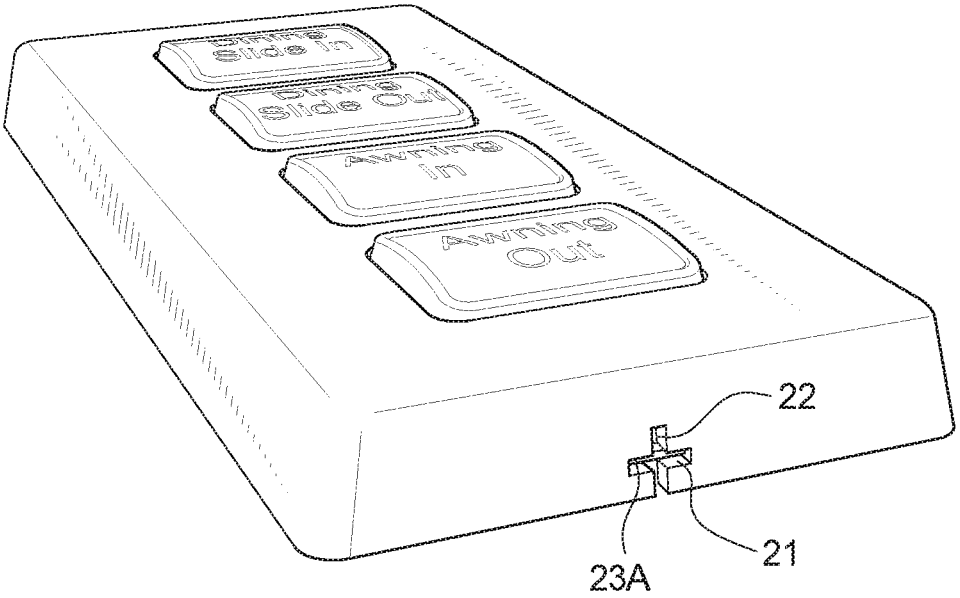
FIG. 10 is a perspective end view of the switch panel assembly of FIG. 2 illustrating two switch cover slots formed as a cross.
Figure 11:
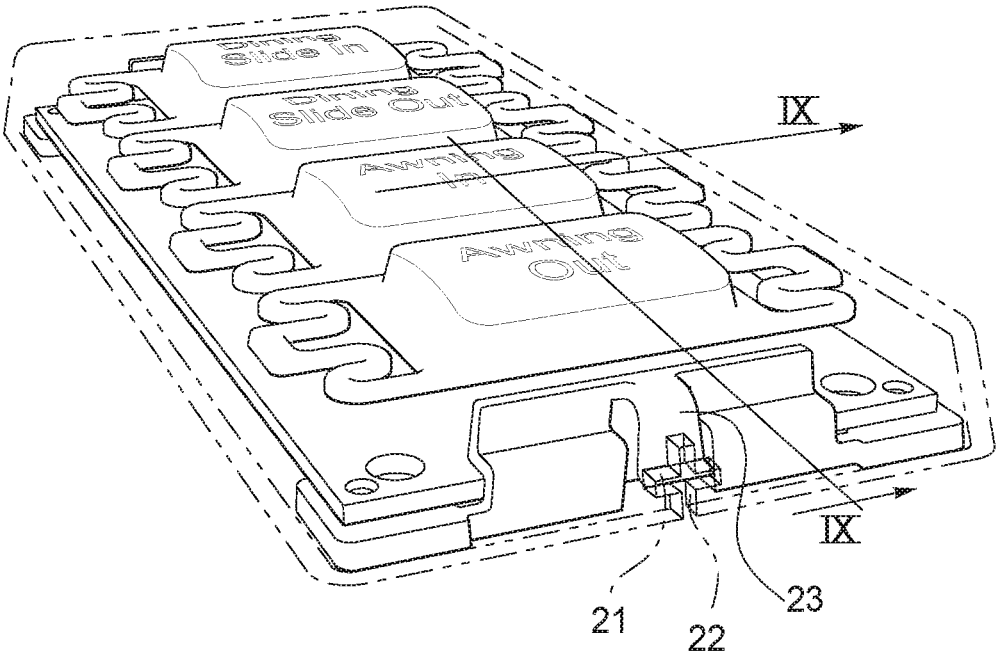
FIG. 11 is the same fragmentary perspective end view as in FIG. 10 but with the switch cover shown transparent for ease of viewing.
Figure 12:
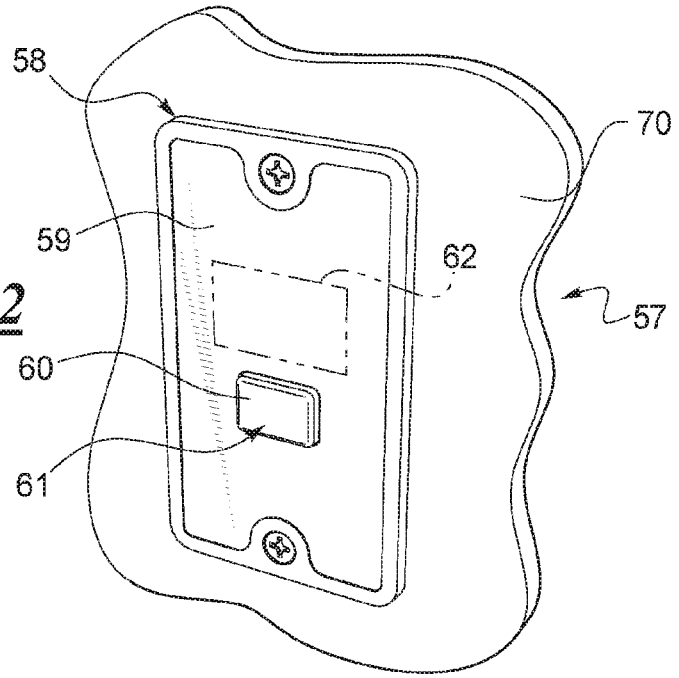
FIG. 12 is a perspective view of a second alternate embodiment of a modular switch panel assembly.
Figure 13:
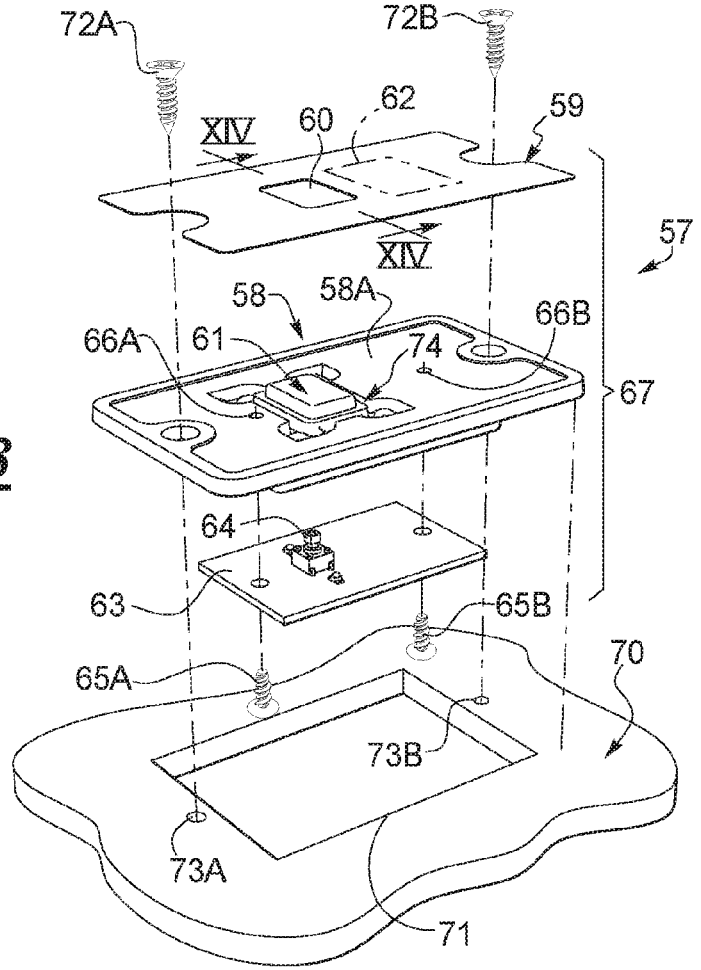
FIG. 13 is an exploded perspective view of the modular switch panel assembly of FIG. 12.

As shown in FIGS. 3, 7, 8, and 9, and particularly FIG. 9, the button portion 12A has a peripheral lip 12AA which surrounds a central raised portion of the switch button 12. This lip, prior to pushing the push button 12, is held by the mounting springy tabs 55 and 56 in contact with an inner surface 16E of the top portion of the cover 16.

With the aforementioned structure, the switch buttons 12-15 are snapped into place by use of the engagement ribs located on each side of the cover that create a ledge for the springy mounting tabs such that the springy mounting tabs are retained between the ribs and the inner surface 16E of the top portion of the cover 16.

The springy mounting tabs 55 and 56 have multiple functions. The first function is to retain the button in the switch cover and the second function is to act as a spring member that returns the button to its start position after the button has been actuated. As a result of the springy connection between the switch cover and the button, the process of actuation of the button is such that no matter where the user pushes on the button, it always results in the actuation of the respective button switch. The function for each button, as previously described, can be printed directly on the face of each button in the switch panel assembly or an indicia label may be applied on each button face. This allows for complete system functional flexibility.

With respect to FIGS. 2, 9, 10, and 11 the assembly of the switch cover sub-assembly 29 to the PCB sub-assembly 30 will now be described. A tip 23A of the retainer spring finger 23 is placed through the switch cover slot 21 and then the switch cover sub-assembly 29 is swung down such that at the opposite end the tip 25A of the retainer spring finger 25 snaps into place through the respective switch cover slot 27. Release of the two sub-assemblies from each other is accomplished by insertion of a flat head screw driver through the slot 21, for example, to push on the tip 23A of the retainer spring finger 23, or alternatively the screw driver is inserted through the orthogonal slot 22 to disengage tip 23A as an alternate way of pushing out the tip 23A of the retainer spring finger 23. Of course the two sub-assemblies may also be released by pushing through the opposite end slots 27 or 28.

The modular switch panel assembly of the one exemplary embodiment is a unique design which accomplishes the following features:

- The switch buttons are mounted and retained by the cover and not affixed to the button switch itself. A result of this configuration is the ability of the switch panel assembly to absorb manufacturing tolerances between components and at the same time provide reliable and consistent functionality and feel to the end user.
- Regardless of where the user pushes on the switch button it always results in the actuation of the button switch.
- The springy mounting tabs of the switch button provide retention of the button to the switch cover and also provide the spring force required to return the button to its start position.
- The retainer spring fingers of the respective PCB retainers provide the method of attaching the PCB sub-assembly to the switch cover sub-assembly and also allow for easy installation and removal of the switch cover sub-assembly.

The method of attaching the PCB retainer to the PCB requires no fasteners, yet it is securely affixed to the PCB.

Although the one current exemplary embodiment is a rectangular switch button, the switch button can be a number of configurations—for example round, square, oval, etc.

Switch button function can be printed or applied as a label directly on the face of each switch button in the switch panel assembly to allow for complete system functional flexibility.

During mounting of the PCB sub-assembly, the cover sub-assembly is not attached to the PCB sub-assembly and therefore is not likely to be damaged.

In the event the user decides to replace a switch button or change the nomenclature configuration in the cover sub-assembly, the user can simply push the old switch button out and insert a new switch button or reconfigure the switch button location. The reason this is possible is due to the springy mounting tabs on each side of the switch button. The act of pushing the switch button out of the cover results in no damage to the switch button in any way and therefore the switch button can be reused or relocated.

The design offers design flexibility with respect to different configurations—for example number of switch buttons, and/or different text in different locations.

The switch cover can be molded in different colors and may also have different finishes depending on customer requirements.

An alternate exemplary embodiment of the modular switch panel assembly will now be described with reference to drawing FIGS. 12 through 15. Here the alternate embodiment switch panel assembly 57 is illustrated in a front perspective view in FIG. 12 and exploded view in FIG. 13 mounted to a mounting surface 70. A switch cover 58 is provided which further comprises a recessed front face 58A receiving a cover label 59 having an aperture 60 through which a switch button 61 protrudes. Indicia 62 are provided on the cover label 59, such as for describing a switching function of the switch button 61 of the switch panel assembly. Although only one switch button 61 is shown, additional switch buttons may be provided.

A PCB 63 having a switch 64 mounted thereon is attached to a rear surface of the switch cover such as by screws 65A, 65B received in screw holes 66A, 66B in the cover. The switch 64 may be a push button switch, although other switch designs may be employed.

The PCB 63 together with the switch cover 58 and cover label 59 form an assembly or module 67 when assembled. This modular assembly 67 is mounted to the mounting surface 70 having a cut-out 71 by use of mounting screws 72A, 72B received in screw holes 73A, 73B. As previously described, the push button switch 64 may be momentary contact or a toggle action and can have one pole or multiple poles.

Figure 14:
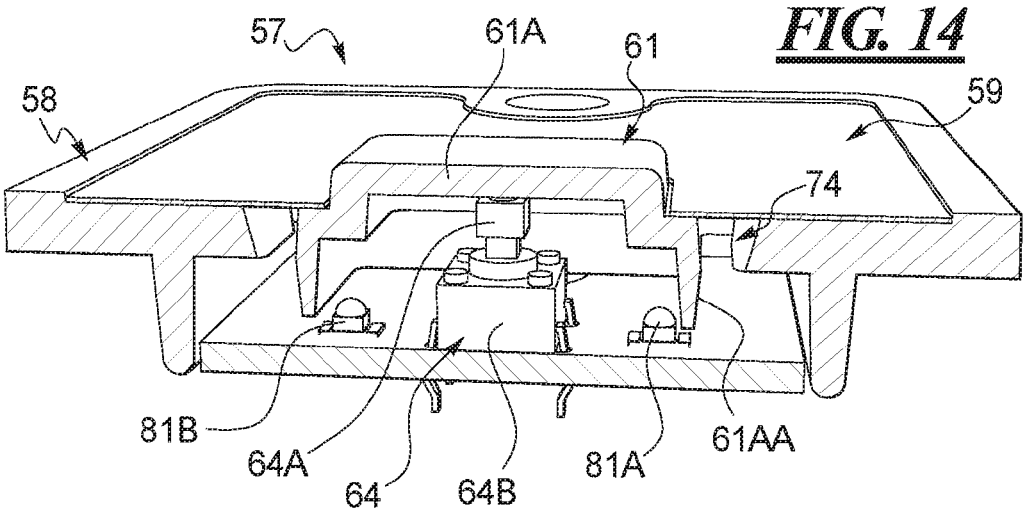
FIG. 14 is a cross-sectional perspective side view taken along section line XIV-XIV in FIG. 13.

As shown in the cross-sectional perspective view of FIG. 14, LEDs 81A, 81B may be provided on the PCB to back light the switch cover 58. As also shown in FIG. 14, the push button switch 64 has a spring loaded push button portion 64A received in a switch body portion 64B. The bottom of a button portion 61A of switch button 61 contacts the top of the push button portion 64A when the switch button 61 is depressed.

The switch button portion 61A has a rectangular skirt 61AA having a leading end which contacts the top of the PCB 63, stopping downward motion of the switch button 61.

Figure 15:
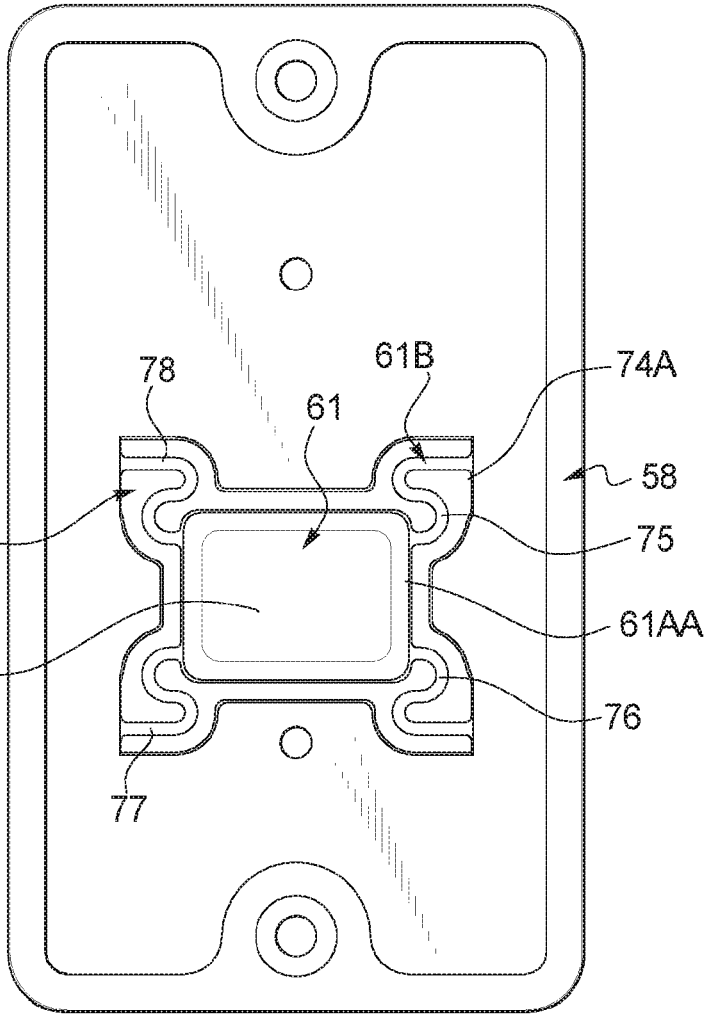
FIG. 15 is a front plan view of a switch cover with integrated switch button employed in the switch panel assembly of FIGS. 12 and 13.

As shown in FIG. 15, the cut-out region 74 in the switch cover 58 is provided for receiving the switch button 61. At four corners of the button portion 61A are provided respective S-shaped spring portions 75, 76, 77, and 78 as spring members and comprising an integral mounting portion 61B of the switch button. For the S-shaped spring portion 75, for example, one end attaches to a side wall 74A of cut-out region 74 and an opposite end connects to an outside surface of the rectangular skirt 61AA near a corner of the switch button main body portion 61A. These S-shaped spring portions are integral with the button portion 61A and all may be formed of plastic.

Thus with the aforementioned described design, the switch button is an integral molded portion of the overall switch cover and interacts with the switch button on the circuit board. The spring members as spring portions are integrated with the button portion of the switch button and allows the switch button to move when pressed.

When the switch button is engaged, for example, the LED indicators may back-light the panel as previously described.

To prevent light bleeding through the aperture, there is a light wall added to the back of the panel that is included in the molding process.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A modular switch panel assembly, comprising:

a switch cover with an aperture;

a switch button having a button portion and an integral mounting portion, said mounting portion comprising at least first and second spring members protruding laterally of and at opposite sides of the button portion, and each of the spring members having a meandering path shape and having one end integral with the button portion and an opposite end attached to the switch cover such that the button portion extends through said aperture, wherein the switch button is configured to mount to the switch cover to form a first sub-assembly;

a printed circuit board having a switch, said printed circuit board being configured to attach to said switch cover such that said switch is adjacent to a bottom surface of the switch button; and first and second retainers, each including a spring finger having a respective tip, and configured to:

attach to the printed circuit board at respective opposite ends of the printer circuit board to form a second sub-assembly, the first and second retainers being mountable to a mounting surface to attach the second sub-assembly to the mounting surface; and engage with and attach to the switch cover to connect the first sub-assembly to the second sub-assembly, wherein each of the tips is receivable in a corresponding slot in a respective end of the switch cover to connect the first and the second sub-assemblies together.

2. The assembly of claim 1 wherein the switch comprises a push button switch having a push button portion and a body portion.

3. The assembly of claim 1 wherein the meandering path shape comprises an S shape.

4. The assembly of claim 1 wherein the spring members and the switch button are all one plastic integral piece.

5. The assembly of claim 1 wherein the first and second spring members each comprise two S-shape portions and a mounting tab portion between the S-shape portions, and wherein said switch cover has a rib adjacent each mounting tab portion with the switch button mounted in the switch cover such that the mounting tab portion is between the respective rib and a bottom surface of the switch cover.

6. The assembly of claim 5 wherein each of the ribs adjacent the respective mounting tab portions comprises three rib portions.

7. The assembly of claim 1 wherein the first and the second retainers each comprise two bosses received within respective holes at the respective opposite ends of the printed circuit board.

8. The assembly of claim 1 wherein one or more other switch buttons are provided with respective push button switches on the printed circuit board and mounted to protrude through respective apertures of the switch cover and the switch button and each of the one or more switch buttons has a different respective indicia associated therewith.

9. The assembly of claim 1 wherein the first and the second retainers are configured to snap on to the respective opposite ends of the printed circuit board to attach to the printed circuit board at the respective opposite ends thereof.

10. The assembly of claim 1 wherein the aperture of the switch cover comprises a rectangle and the switch button portion has a rectangular shape.

11. The assembly of claim 1 wherein said switch cover comprises a front face and a cover label received on said front face and having an aperture as said aperture of said switch cover.

12. The assembly of claim 11 wherein said front face receiving the cover label is recessed.

13. The assembly of claim 1 wherein:

the switch cover has a cut-out region in which is located said switch button, and said switch button includes said first and second spring members integral with opposite sides of said cut-out region.

14. The assembly of claim 1 wherein the switch cover, the switch button, and at least two spring members are all integral plastic.

15. The assembly of claim 12 wherein four of said spring members are provided, each of which has an S-shape and is configured to integrally mount to respective side portions of said cut-out region.

16. The assembly of claim 11 wherein the printed circuit board is mounted to a back of said switch cover and said printed circuit board is adapted to be received in a cut-out of the mounting surface.

17. The assembly of claim 11 wherein an indicia is provided on the cover label adjacent said aperture cover.

18. A modular switch panel assembly, comprising:

a switch cover with a plurality of apertures;

a plurality of switch buttons each having a button portion and an integral mounting portion, the plurality of switch buttons being configured to mount to the switch cover to form a first sub-assembly, wherein said mounting portions comprise at least first and second integral spring members protruding laterally and at opposite sides of the respective button portion, each of the at least first and second spring members having two meandering portions with a mounting tab portion between the two meandering portions, the respective mounting tab portions of the at least first and second spring members being attached to the switch cover by at least one respective rib on the switch cover configured to trap the respective mounting tab portion between the at least one respective rib and a bottom of the switch cover such that the respective button portions extend through a respective aperture of said plurality of apertures of the switch cover; and a printed circuit board having a plurality of switches, said printed circuit board being configured to attach to first and second retainers at respective opposite ends thereof to form a second sub-assembly, the first and second retainers being mountable to a mounting surface to attach the second sub-assembly to the mounting surface, wherein each of the first and second retainers include a respective spring finger configured to engage with and attach to the switch cover to connect the first sub-assembly to the second sub-assembly, said printed circuit board being configured to attach to said switch cover by said spring fingers such that respective push button portions of the plurality of switches are adjacent to a respective bottom surfaces of the plurality of switch buttons.

19. A modular switch panel assembly, comprising:

a switch cover comprising a cover label received on a front face of said switch cover, said cover label having an aperture;

said switch cover having a cut-out region substantially aligned with said aperture;

a switch button having a button portion and an integral mounting portion, said mounting portion comprising first, second, third and fourth spring members protruding outwardly from said button portion, and each of the first, second, third, and fourth spring members having a meandering path shape and having one end integral with the button portion and an opposite end integrally attached to the switch cover at side wall portions of the cut-out region and such that the button portion extends through said aperture;

a printed circuit board having a switch, said printed circuited board being attached to said switch cover such that the switch is aligned adjacent to a bottom surface of the switch button; and at least one mounting surface attachment for attaching the switch cover with the attached printed circuit board to a mounting surface.

* * * * *